US011372360B2

(12) United States Patent
Kenmotsu

(10) Patent No.: US 11,372,360 B2
(45) Date of Patent: Jun. 28, 2022

(54) IMAGE FORMING APPARATUS, PAPER CONVEYANCE METHOD, AND NON-TRANSITORY COMPUTER READABLE MEDIUM USING BOTH SPEED AND POSITION CONTROL

(71) Applicant: TOSHIBA TEC KABUSHIKI KAISHA, Tokyo (JP)

(72) Inventor: Takahide Kenmotsu, Fuji Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/176,214

(22) Filed: Feb. 16, 2021

(65) Prior Publication Data

US 2021/0165357 A1 Jun. 3, 2021

Related U.S. Application Data

(63) Continuation of application No. 16/550,458, filed on Aug. 26, 2019, now Pat. No. 10,955,788.

(51) Int. Cl.

| | |
|---|---|
| ***G03G 15/00*** | (2006.01) |
| *G03G 15/08* | (2006.01) |
| *G03G 21/16* | (2006.01) |
| *G03G 15/20* | (2006.01) |
| *G03G 15/16* | (2006.01) |

(52) U.S. Cl.

CPC ..... *G03G 15/6561* (2013.01); *G03G 15/0887* (2013.01); *G03G 15/161* (2013.01); *G03G 15/2017* (2013.01); *G03G 15/5008* (2013.01); *G03G 21/1685* (2013.01); *G03G 2215/00409* (2013.01); *G03G 2215/00599* (2013.01)

(58) Field of Classification Search

CPC ..... G03G 15/6558; G03G 15/6561; G03G 15/6564; G03G 2215/00405; G03G 2215/00409; G03G 2215/00599; G03G 2215/00721

USPC ..... 399/301, 394, 396

See application file for complete search history.

(56) References Cited

U.S. PATENT DOCUMENTS

| | | | |
|---|---|---|---|
| 7,756,463 | B2 | 7/2010 | Takahashi |
| 9,106,164 | B2 | 8/2015 | Seki et al. |

(Continued)

FOREIGN PATENT DOCUMENTS

| | | |
|---|---|---|
| JP | 58-014159 | 1/1983 |
| JP | 01-291260 | 11/1989 |

(Continued)

*Primary Examiner* — Robert B Beatty

(74) *Attorney, Agent, or Firm* — Amin, Turocy & Watson, LLP

(57) ABSTRACT

According to one embodiment, an image forming apparatus includes: a registration roller; a motor configured to drive the roller; and a controller configured to control the motor. The roller is disposed at a first position on a conveyance path of paper on which an image is to be formed, and sends out the paper toward a second position on the conveyance path. The second position is downstream from the first position on the conveyance path and is an image transfer position on the paper. The controller controls the motor by using both speed control and position control when the leading end of the paper is at a position from the first position to the second position, and controls the motor by using only the speed control when the leading end of the paper reaches the second position.

20 Claims, 8 Drawing Sheets

(56) References Cited

U.S. PATENT DOCUMENTS

| | | | |
|---|---|---|---|
| 9,483,037 | B2 | 11/2016 | Shimizu et al. |
| 2011/0175281 | A1 | 7/2011 | Takahashi |

FOREIGN PATENT DOCUMENTS

| | | |
|---|---|---|
| JP | 04-204459 | 7/1992 |
| JP | 2001-63168 | 3/2001 |
| JP | 2011-149985 | 8/2011 |
| JP | 2013-094037 | 5/2013 |
| JP | 2019-045643 | 3/2019 |

IMAGE FORMING APPARATUS, PAPER CONVEYANCE METHOD, AND NON-TRANSITORY COMPUTER READABLE MEDIUM USING BOTH SPEED AND POSITION CONTROL

CROSS-REFERENCE TO RELATED APPLICATION

This application is a Continuation of application Ser. No. 16/550,458 filed on Aug. 26, 2019, the entire contents of which are incorporated herein by reference.

FIELD

Embodiments described herein relate generally to an image forming apparatus, a paper conveyance method, and a non-transitory computer readable medium.

BACKGROUND

An image forming apparatus forms an image on paper. A general image forming apparatus forms a latent image on a photosensitive body by irradiating the photosensitive member with image light. The image forming apparatus obtains a visible image by visualizing the latent image with a developing agent which is a developer. The image forming apparatus moves the visible image onto the paper. Alternatively, the image forming apparatus moves the visible image onto an intermediate transfer belt for the moment, and further moves the visible image moved onto the intermediate transfer belt onto the paper. Thereafter, the image forming apparatus fixes the visible image moved onto the paper to the paper by a fixing unit.

The image forming apparatus includes a copying apparatus, a printer apparatus, and a multi-function peripheral (hereinafter, abbreviated as an MFP) including both functions of the copying apparatus and the printer apparatus.

In the MFP, the paper stored in a paper cassette is moved from the paper cassette to an image transfer position which is a position at which the visible image is moved onto the paper, and further moved from the image transfer position to the fixing unit by using a plurality of rollers disposed on a conveyance path. These rollers are driven by a motor.

In drive control of the motor, there are two types of drive control; a speed control to keep a rotational speed of the motor constant and position control that always matches the current rotational position of the motor with a target. With the speed control only, a position error is accumulated, and with the position control only, speed stability becomes disadvantageous.

In particular, the positional accuracy and the speed stability at the image transfer position have a significant influence on the quality of the image formed on the paper. Therefore, the drive control of the motor is required to achieve the high positional accuracy and the speed stability at the image transfer position.

DETAILED DESCRIPTION

In general, according to one embodiment, an image forming apparatus forms an image on paper. The image forming apparatus includes a registration roller, a motor configured to drive the registration roller, and a controller configured to control the motor. The registration roller is disposed at a first position on a conveyance path of paper on which an image is to be formed. The registration roller is configured to send out the paper toward a second position on the conveyance path. The second position is downstream from the first position on the conveyance path and is an image transfer position on the paper. The controller is configured to control the motor by using both speed control to keep a rotational speed of the motor as a target speed and position control to keep a rotational position of the motor as a target position when the leading end of the paper is at a position from the first position to the second position. The controller is configured to control the motor by using only the speed control when the leading end of the paper reaches the second position.

Hereinafter, an embodiment will be described with reference to the accompanying drawings.

Figure 1:
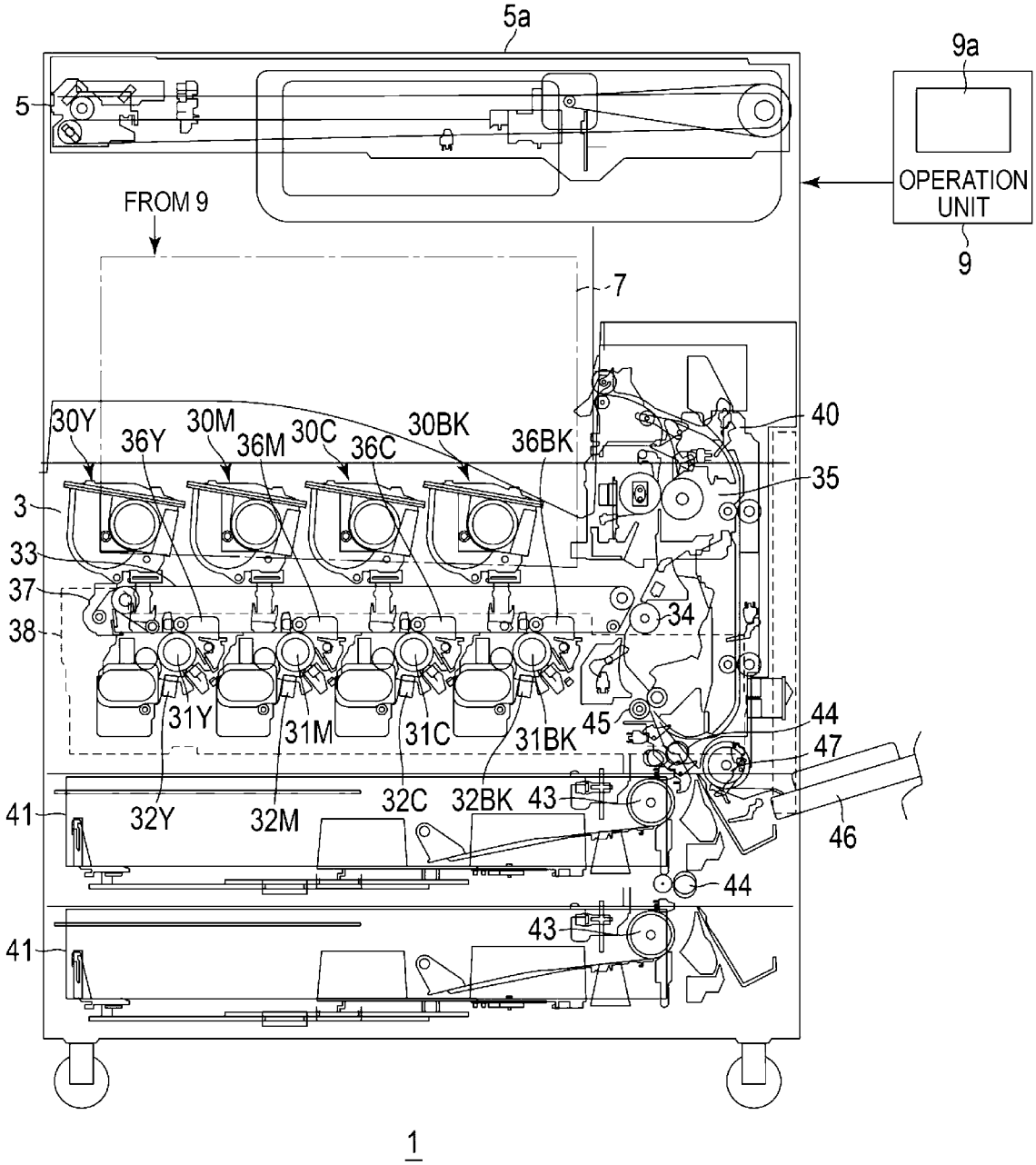
FIG. 1 is a mechanical configuration diagram illustrating an example of an image forming apparatus according to an embodiment.
Figure 2:
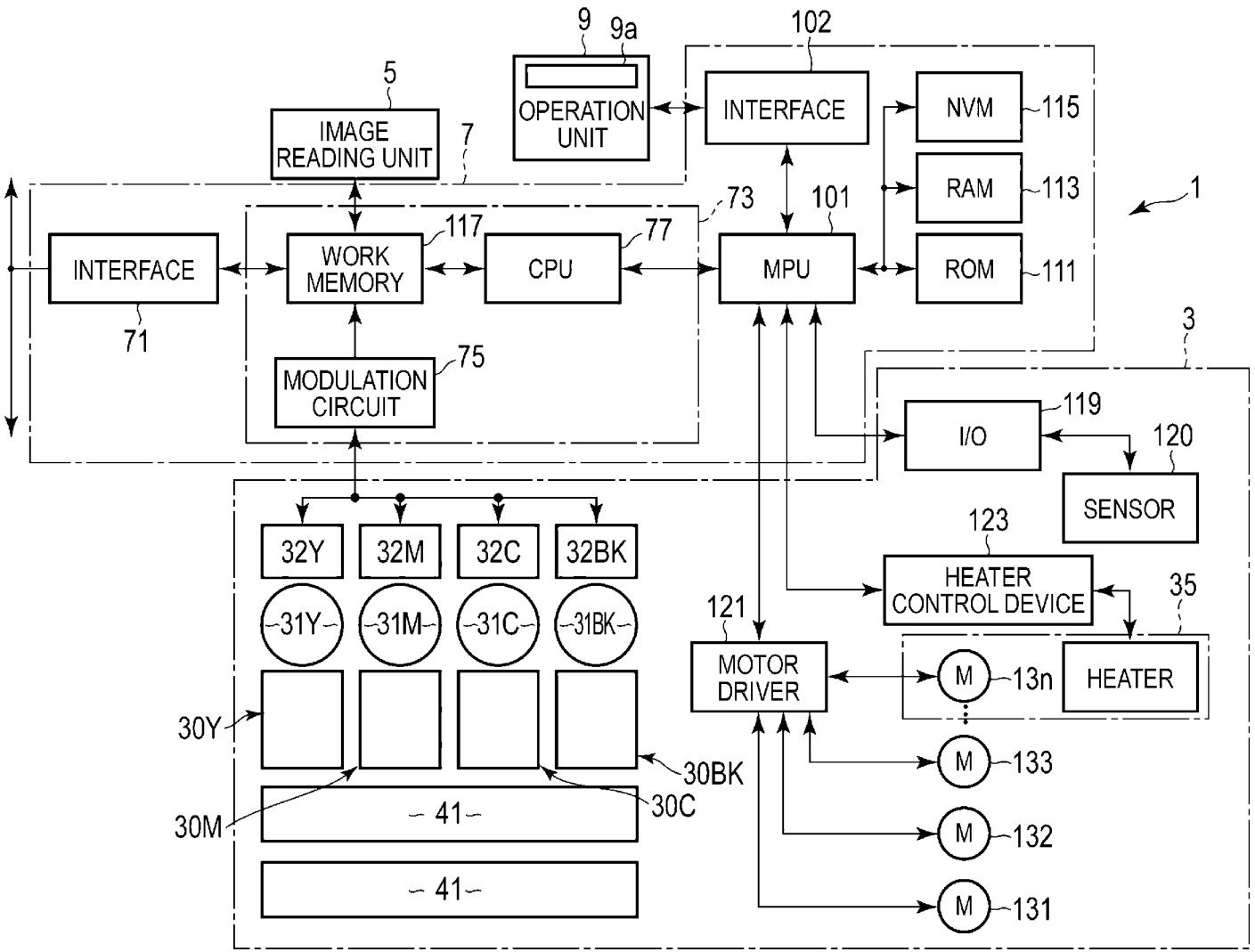
FIG. 2 is a block diagram illustrating an electrical configuration of the image forming apparatus.

FIG. 1 is a mechanical configuration diagram illustrating an example of an image forming apparatus of an embodiment, and FIG. 2 is a block diagram illustrating an electrical configuration of the image forming apparatus.

The image forming apparatus of the embodiment is a multi-function peripheral (hereinafter, referred to as an MFP) 1 including both functions of a copying apparatus and a printer apparatus. The MFP 1 may be also provided with a function of a facsimile apparatus.

The MFP 1 includes at least an image forming unit 3, an image reading unit 5, and a signal processing and an operation control unit (a circuit substrate unit) 7. Further, an operation unit (a display panel) 9 is positioned at a predetermined position of the MFP 1.

The image forming unit 3 forms a visible image corresponding to image data on a sheet-like paper which is paper or a resin sheet. The image data may be, for example, data generated by the image reading unit 5 or data from the outside. The data from the outside may be data supplied by a storage (portable) medium such as a semiconductor memory and the like, or data supplied via an interface 71 by a supply source on a network.

The image reading unit 5 acquires a character, an illustration, a photograph, and the like on an object to be read as light and darkness of light, and generates image data corresponding to the light and darkness.

The image reading unit 5 includes at least an original document table (original document glass) 5*a*, an illumination device, and an image sensor. The illumination device irradiates an original document supported by the original document table 5*a*, that is, the object to be read with illumination light. The image sensor receives the reflected light (image information) reflected by the original document, and generates an image signal by photoelectric conversion of the received reflected light. The image sensor is, for example, a CCD sensor or a complementary metal-oxide-semiconductor (CMOS) sensor.

The signal processing and operation control unit 7 converts the image signal generated by the image reading unit 5 into image data suitable for image formation to be performed by the image forming unit 3. The signal processing and operation control unit 7 performs predetermined processing on the image signal from the image sensor. The predetermined processing includes, for example, character specification, contour correction, color tone correction (color conversion, RGB→CMY, density), halftone (gradation), γ characteristics (an input density value versus output density), and the like for an output image (print-out). The image signal and the image data are stored in a storage device (not illustrated) such as a hard disk drive (HDD). Further, the image signal and the image data can also be stored in a semiconductor memory (not illustrated), and the like that can be picked up by the MFP 1.

The image forming unit 3 includes first to fourth monochromatic image forming stations (visible image forming units) 30Y, 30M, 30C, and 30BK, and first to fourth exposure devices 32Y, 32M, 32C, and 32BK. The respective monochromatic image forming stations 30Y, 30M, 30C, and 30BK include photosensitive drums (image carriers) 31Y, 31M, 31C, and 31BK, and a developing device and a transfer device (a primary transfer unit). The photosensitive drums 31Y, 31M, 31C, and 31BK generate and hold a latent image corresponding to exposure light from the exposure devices 32Y, 32M, 32C, and 32BK, that is, image light.

The image forming unit 3 also includes an intermediate transfer belt (a visible image holding (primary transfer) unit) 33, a transfer roller (a secondary transfer unit) 34, a fixing unit 35, first to fourth waste toner collecting mechanisms 36Y, 36M, 36C, and 36BK, an intermediate transfer belt cleaner 37, a waste toner recovery device 38, and the like.

In each of the monochromatic image forming stations (the visible image forming units) 30Y, 30M, 30C, and 30BK, the first to fourth exposure devices 32Y, 32M, 32C, and 32BK irradiate the respective photosensitive drums 31Y, 31M, 31C, and 31BK with the exposure light, that is, the image light. A potential held by each of the photosensitive drums 31Y, 31M, 31C, and 31BK varies depending on the intensity of the image light.

The image forming unit 3 also includes an automatic duplex unit (hereinafter, abbreviated as an ADU) 40, at least one paper feed cassette 41, a paper feed roller 43 attached to each paper feed cassette, a conveyance roller 44, and a registration roller 45. The MFP 1 of the embodiment includes two paper feed cassettes 41. Further, a manual feed tray 46 and a paper feed roller 47 attached to the manual feed tray 46 are positioned in the front stage of the registration roller 45. Further, the paper feed cassette 41 can be used in multiple stages in layers.

The first to the fourth exposure devices 32Y, 32M, 32C, and 32BK output the image light. The image light is obtained by converting the image data from an image processing unit 73 (FIG. 2) of the signal processing and operation control unit 7 into light intensity. The image light output from the first to the fourth exposure devices 32Y, 32M, 32C, and 32BK respectively form the latent image on the photosensitive drums 31Y, 31M, 31C, and 31BK of the first to the fourth monochromatic image forming stations 30Y, 30M, 30C, and 30BK. That is, the potentials of the photosensitive drums 31Y, 31M, 31C, and 31BK of the respective monochromatic image forming stations 30Y, 30M, 30C, and 30BK are changed depending on the intensity of the image light from the first to the fourth exposure devices 32Y, 32M, 32C, and 32BK, and the potential difference thereof becomes the latent image (an electrostatic image).

Each of the monochromatic image forming stations 30Y, 30M, 30C, and 30BK respectively form a visible image of respective colors of C (cyan), M (magenta), Y (yellow), and BK (black). The developing device supplies toner to the above-described latent image held by each of the photosensitive drums 31Y, 31M, 31C, and 31BK, thereby visualizing, that is, developing the image. The transfer device moves the toner image (the visible image) held by each of the photosensitive drums 31Y, 31M, 31C, and 31BK to the intermediate transfer belt 33. Further, the alignment (position) of each of the monochromatic image forming stations 30Y, 30M, 30C, and 30BK, that is, the order of the colors is determined according to the image forming process and characteristics of the toner.

The intermediate transfer belt 33 holds the toner image formed by each of the monochromatic image forming stations 30Y, 30M, 30C, and 30BK, and conveys the toner image in a paper direction. The transfer roller 34 moves the toner image conveyed by the intermediate transfer belt 33 to paper. The fixing unit 35 fixes the toner, that is, the toner image moved from the intermediate transfer belt 33 to the paper by the transfer roller 34 onto the paper.

The first to the fourth waste toner collecting mechanisms 36Y, 36M, 36C, and 36BK collect transfer residual toner in the vicinity of the transfer devices (the primary transfer units) of the respective monochromatic image forming stations 30Y, 30M, 30C, and 30BK. The transfer residual toner is surplus toner remaining in each photosensitive drum without moving from the photosensitive drum to the intermediate transfer belt 33. The transfer residual toner is removed from each of the photosensitive drums by a cleaner (not illustrated) provided in each of the waste toner collecting mechanisms 36Y, 36M, 36C, and 36BK.

The intermediate transfer belt cleaner 37 collects transfer residual toner remaining on the intermediate transfer belt 33 without moving from the intermediate transfer belt 33 to the paper in the vicinity of the transfer roller (the secondary transfer unit) 34.

The waste toner recovery device 38 recovers the transfer residual toner collected by the waste toner collecting mechanisms 36Y, 36M, 36C, and 36BK and the transfer residual toner collected by the intermediate transfer belt cleaner 37.

The paper feed roller 43 pulls out the paper from the paper feed cassette 41 at a predetermined timing corresponding to an image forming operation in each of the monochromatic image forming stations 30Y, 30M, 30C, and 30BK. The conveyance roller 44 conveys the pulled-out paper to the registration roller 45 disposed at the first position on the conveyance path. The conveyance roller 44 abuts the leading end of the paper in the conveyance direction against an abutting part (hereinafter, referred to as a nip) of the registration rollers 45 in a stopped state. In this state, the conveying roller 44 further conveys the paper thereto, thereby bending the paper. By bending the leading end of the paper in this manner, the registration rollers 45 align the leading end of the paper in the conveyance direction in parallel with the registration rollers 45, thereby correcting the inclination of the paper. After aligning the leading end of the paper sent out from the conveyance roller 44 at the nip in this manner, the registration rollers 45 restart according to the toner image formed on the intermediate transfer belt 33, and then conveys the paper to the side of the transfer roller 34. That is, the registration roller 45 sets the timing, at which the paper moves to the second position which is an image transfer position where the intermediate transfer belt 33 and the transfer roller 34 come into contact with each other, corresponding to the image forming operation in each of the monochromatic image forming stations 30Y, 30M, 30C, and 30BK.

The fixing unit 35 heats the paper and the toner in a state of being electrostatically attached to the paper, and applies pressure thereto. Thus, the toner is fixed onto the paper. As described above, the paper holding the toner (the toner image) fixed by the fixing unit 35 is moved to a space between the image reading unit 5 and the image forming unit 3 or to the ADU 40 as an output image (print-out).

The ADU 40 inverts the front and back surfaces of the paper so that the toner can be moved onto a second surface which is the back surface of a first surface of the paper where the toner image comes into close contact therewith. Then, the ADU 40 moves the paper whose front and back surfaces are inverted to the registration roller 45.

The signal processing and operation control unit 7 includes the interface (an image input unit) 71, the image processing unit 73, and the like as an example illustrated in FIG. 2. The image processing unit 73 includes a modulation circuit (an exposure signal generation unit) 75, a CPU 77, and the like.

The interface 71 receives image data supplied from an external device such as a personal computer (PC), and the like, or via a network, and the like.

The image processing unit 73 performs predetermined processing on the image signal generated by the image reading unit 5 or the image data from the interface 71 with respect to the character specification, the contour correction, the color tone correction, the γ characteristics, and the like. The modulation circuit 75 converts the image data on which the predetermined processing is performed into a modulated signal, that is an exposure signal to be used as the exposure light by the first to the fourth exposure devices 32Y, 32M, 32C, and 32BK.

The CPU 77 controls the processing of the image data in the image processing unit 73.

The signal processing and operation control unit 7 also includes a main control unit (hereinafter referred to as an MPU) 101 that controls the overall operation of the MFP 1 including the image processing unit 73 (the CPU 77), the image forming unit 3, and the image reading unit 5. The MPU 101 is a controller that controls the image reading operation, the image forming operation, and the like in the MFP 1.

The MPU 101 receives an instruction input with respect to the MFP 1, that is, a control input from the operation unit 9 that receives an operation input via an interface 102. The MPU 101 controls each unit (an element) of the MFP 1 according to the control input from the operation unit 9.

The operation unit 9 includes a display unit 9*a*. The display unit 9*a* displays the state of each unit of the MFP 1 by the display (a user interface) known as, for example, a character string or a symbol (a pictogram and an icon), and the like. The display unit 9*a* also functions as a touch panel, receives the instruction input from a user, that is, the control input, and displays the received input.

The signal processing and operation control unit 7 also includes a ROM (a program memory) 111, a RAM 113, an NVM (Non-Volatile Memory) 115, and a page memory (a work memory 117) used for image processing in the image processing unit 73.

The MPU 101 is connected to a motor driver 121 that controls the rotation of arbitrary motors 131, 133, . . . , 13*n* provided in the image forming unit 3. The plurality of motors includes, for example, a plurality of motors for driving the first to the fourth monochromatic image forming stations 30Y, 30M, 30C, and 30BK, and the intermediate transfer belt 33. Further, the plurality of motors includes a plurality of motors for driving elements between the paper feed cassette 41 and the fixing unit 35 (the ADU 40) which are related to the paper conveyance such as, the paper feed roller 43, the conveyance roller 44, the registration roller 45, the transfer roller 34, and the like. For example, the registration roller 45 is driven by the motor 133. Further, the plurality of motors includes motors for driving the fixing unit 35 such as the motor 13*n*.

The MPU 101 is also connected to a heater control device 123 for driving a heater that sets a temperature of the fixing unit 35.

The MPU 101 is further connected to an I/O port 119, and an output and the like from a plurality of sensors 120 provided in respective units of the image forming unit 3 are input via the I/O port 119. The plurality of sensors 120 include, for example, a sensor that detects a rotational position of the motor 133 for driving the registration roller 45.

Figure 3:
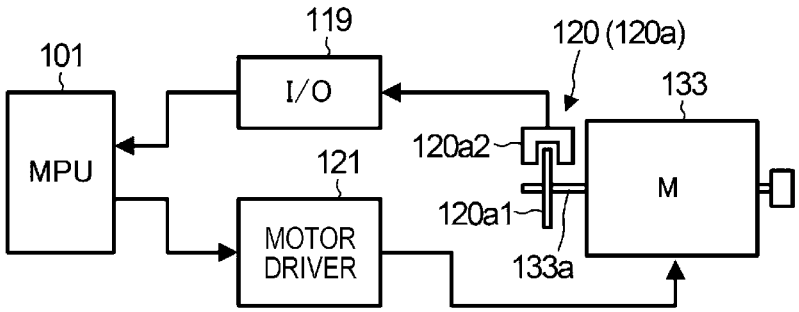
FIG. 3 is a schematic diagram illustrating an example of a sensor that detects a rotational position of a motor.

FIG. 3 is a schematic diagram illustrating an example of the sensor 120 that detects the rotational position of the motor 133 for driving the registration roller 45. The motor 133 may be, for example, a DC motor or a brushless DC motor. The sensor 120 may be, for example, a rotary encoder 120*a*. The rotary encoder 120*a* can be configured with a disk 120*a*1 mounted on a shaft 133*a* of the motor 133 and a photo interrupter 120*a*2 that detects a hole or a notch provided in the disk 120*a*1.

The MPU 101 performs feedback control of the motor 133 based upon an output of the sensor 120 (the rotary encoder 120*a*). In the embodiment, the MPU 101 performs the drive control of the motor 133 by two types of control methods. One of the control methods is speed control, and the other control method is a combination of the speed control and position control.

Figure 4:
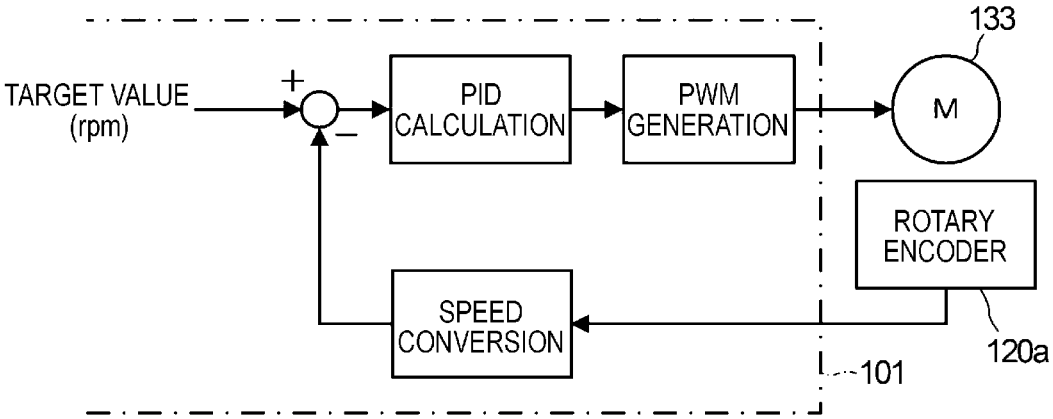
FIG. 4 is a functional block diagram of a motor control system only by speed control implemented by an MPU.

FIG. 4 is a functional block diagram of a motor control system only by the speed control implemented by the MPU 101. The MPU 101 receives a pulse signal output from the rotary encoder 120*a* via the I/O port 119 and converts the received pulse signal into an actual rotational speed of the motor 133. The rotational speed is obtained by the number of pulses per unit time. The MPU 101 calculates a difference between a target value of the rotational speed, that is, the number of rotations and the actual rotational speed, and calculates an operation amount as a command value by performing a PID calculation on the difference. Next, the MPU 101 converts the calculated operation amount into a PWM control signal. That is, the MPU 101 generates a PWM voltage command value in which PWM duty is changed depending on the calculated operation amount as the PWM control signal. The MPU 101 supplies the PWM control signal to the motor driver 121, thereby causing the motor driver 121 to drive the motor 133. Thus, the MPU 101 can apply speed feedback by changing the PWM duty depending on the difference between the target rotational speed and the actual rotational speed.

Figure 5A:
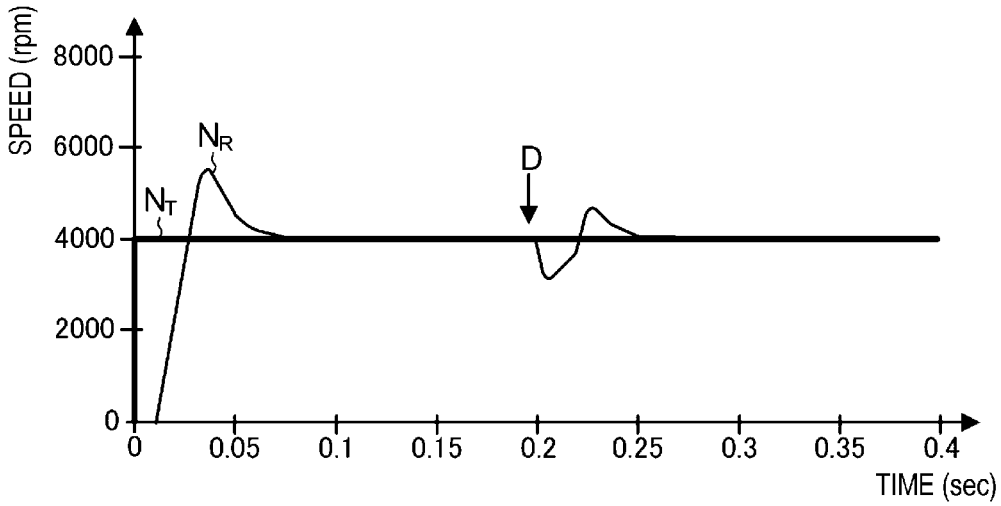
FIG. 5A is a time response characteristic diagram of a rotational speed.
Figure 5B:
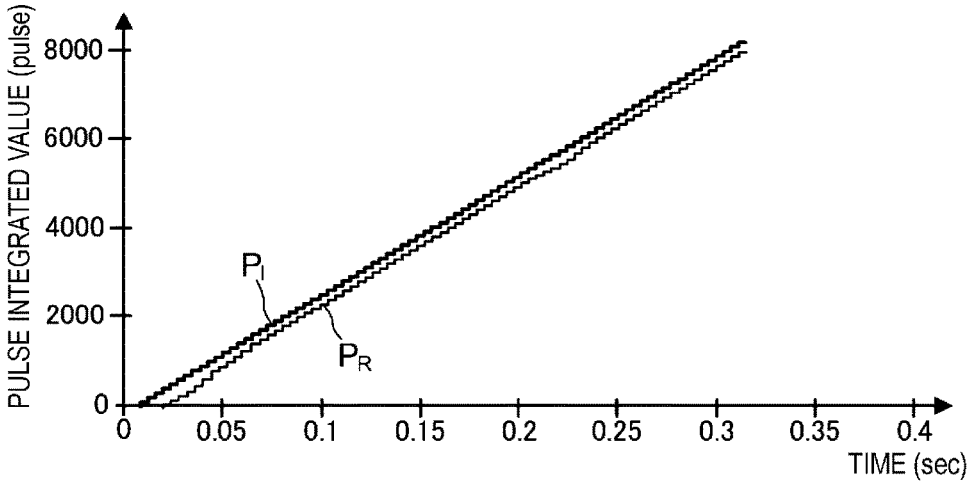
FIG. 5B is a time response characteristic diagram of a pulse integrated value.

FIG. 5A is a time response characteristic diagram of a rotational speed N, that is, the number of rotations in the motor control system only by the speed control. In the same diagram, a thick solid line indicates a target rotational speed $N_T$ and a thin solid line indicates an actual rotational speed $N_R$. FIG. 5B is also a time response characteristic diagram of a pulse integrated value P, that is, the number of times of rotations. In the same diagram, a thick solid line indicates the ideal number of pulses $P_I$, and a thin solid line indicates the actual number of pulses $P_R$. As illustrated in FIG. 5A, the actual rotational speed $N_R$ generates a speed overshoot with respect to the target rotational speed $N_T$ when the motor is activated, and further generates a speed fluctuation even when a disturbance D such as a load fluctuation, and the like occurs. Since a position (a distance) error is accumulated by such speed overshoot and speed fluctuation, the actual pulse number $P_R$ does not converge on the ideal number of pulses $P_I$ as illustrated in FIG. 5B. Here, the ideal number of pulses $P_I$ is a motor rotational position (the distance) calculated from the target value of the rotational speed (the number of rotations). As described above, in the motor drive control only by the speed control, the motor rotational position (the distance) during a fixed time is not constantly fixed.

Figure 6:
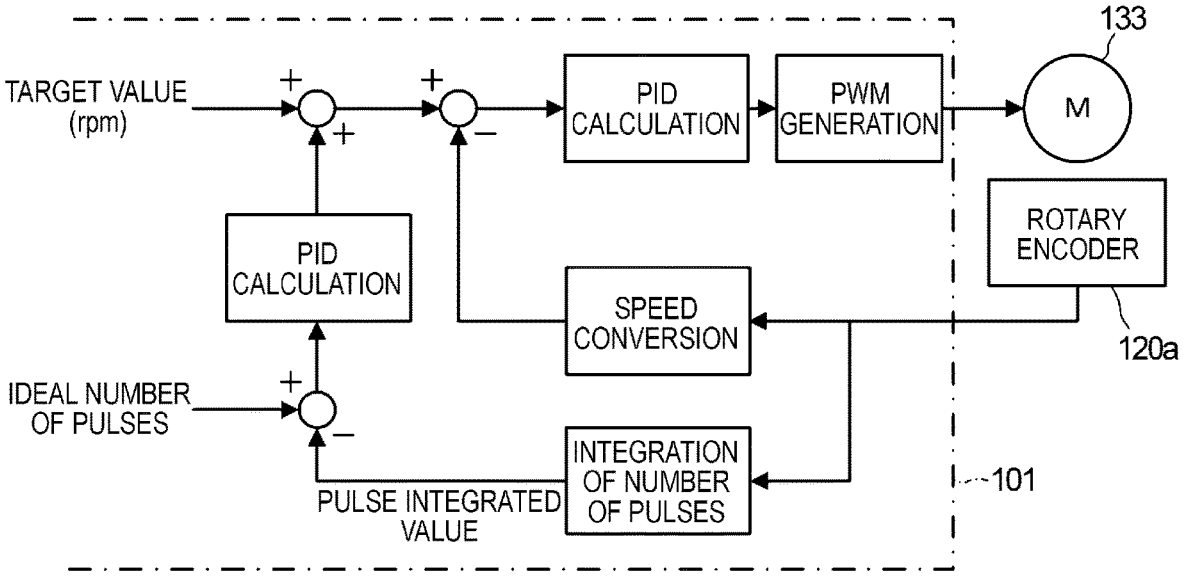
FIG. 6 is a functional block diagram of a motor control system using the speed control and position control implemented by the MPU.

FIG. 6 is a functional block diagram of a motor control system using the speed control and the position control implemented by the MPU 101. The MPU 101 receives the pulse signal indicating the actual rotational speed of the motor 133 output from the rotary encoder 120*a* via the I/O port 119, and integrates the number of pulses, thereby obtaining the pulse integrated value. The MPU 101 calculates a difference between the ideal number of pulses, which is the distance calculated from the target value of the rotational speed (the number of rotations), and the pulse integrated value, and performs the PID calculation on the difference therebetween, thereby calculating a correction amount of the target value of the rotational speed. The MPU 101 adds the correction amount to the target value of the rotational speed, and uses the result as the target value of the rotational speed for the speed control as illustrated in FIG. 4. As described above, when the combination of the speed control and the position control is executed, the MPU 101 adds a control loop using a cumulative value of the number of motor pulses and the ideal number of pulses to the speed control, and changes the target value of the rotational speed of a speed feedback loop.

Figure 7A:
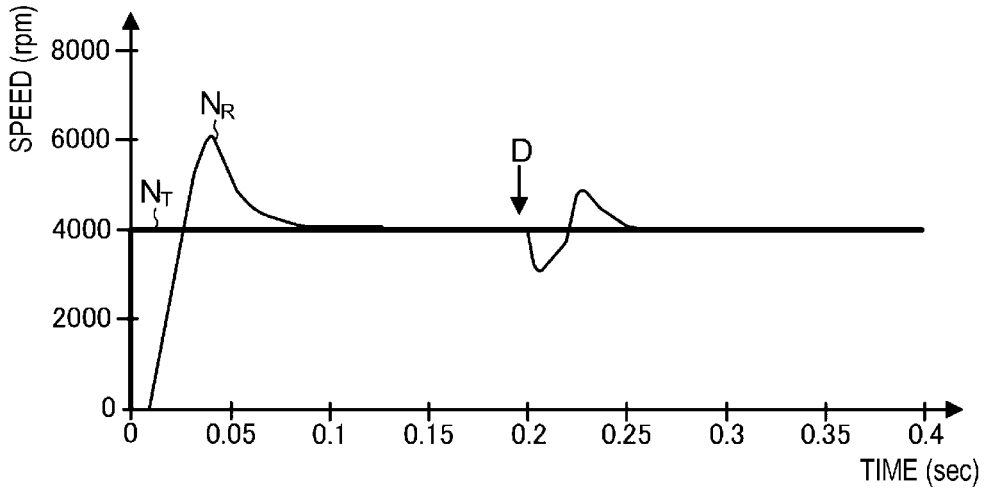
FIG. 7A is a time response characteristic diagram of a rotational speed.
Figure 7B:
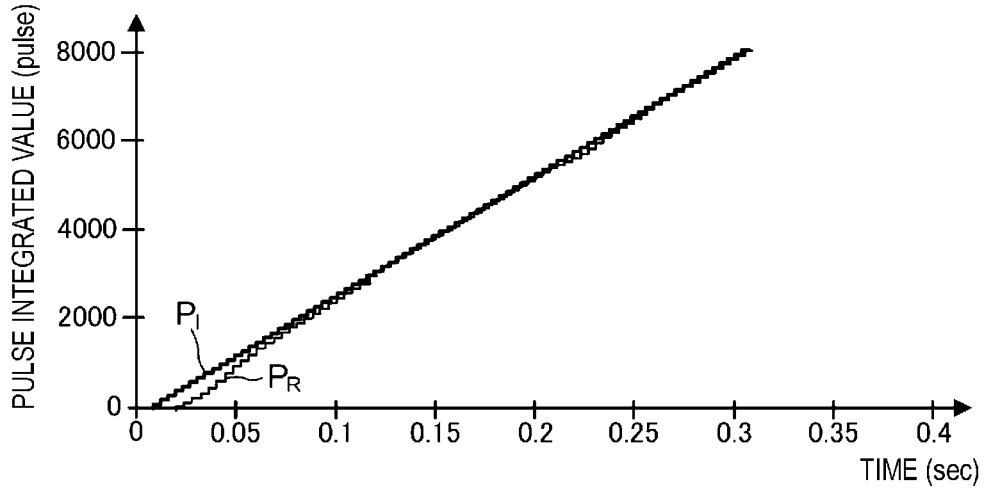
FIG. 7B is a time response characteristic diagram of a pulse integrated value.

FIG. 7A is a time response characteristic diagram of rotational speed (the number of rotations) N in the motor control system using the speed control and the position control. In the same diagram, a thick solid line indicates the target rotational speed $N_T$ and a thin solid line indicates the actual rotational speed $N_R$. FIG. 7B is also a time response characteristic diagram of the pulse integrated value (the number of times of rotations) P. In the same diagram, a thick solid line indicates the ideal number of pulses $P_I$, and a thin solid line indicates the actual number of pulses $P_R$. As illustrated in FIG. 7A, in the same manner as the case where the motor drive control only by the speed control is executed, the actual rotational speed $N_R$ generates the speed overshoot with respect to the target rotational speed $N_T$ when the motor is activated, and further generates the speed fluctuation even when the disturbance D such as the load fluctuation and the like occurs. However, as illustrated in FIG. 7B, by adding the position control, the current actual number of pulses $P_R$ converges on the ideal number of pulses $P_I$, so that the motor rotational position (the distance) during a fixed time can be kept constant. However, in the motor drive control using the speed control and the position control, the convergence time and the overshoot amount of the speed become deteriorate in comparison with the case where the motor drive control only by the speed control is executed, thereby being disadvantageous in the speed stability.

Therefore, in the embodiment, the speed control and the combination of the speed control and the position control are switched.

Hereinafter, the operation of the MFP 1 will be described. Further, the content of processing described hereinafter is one example, and various processing capable of obtaining the same result can be appropriately used.

Figure 8:
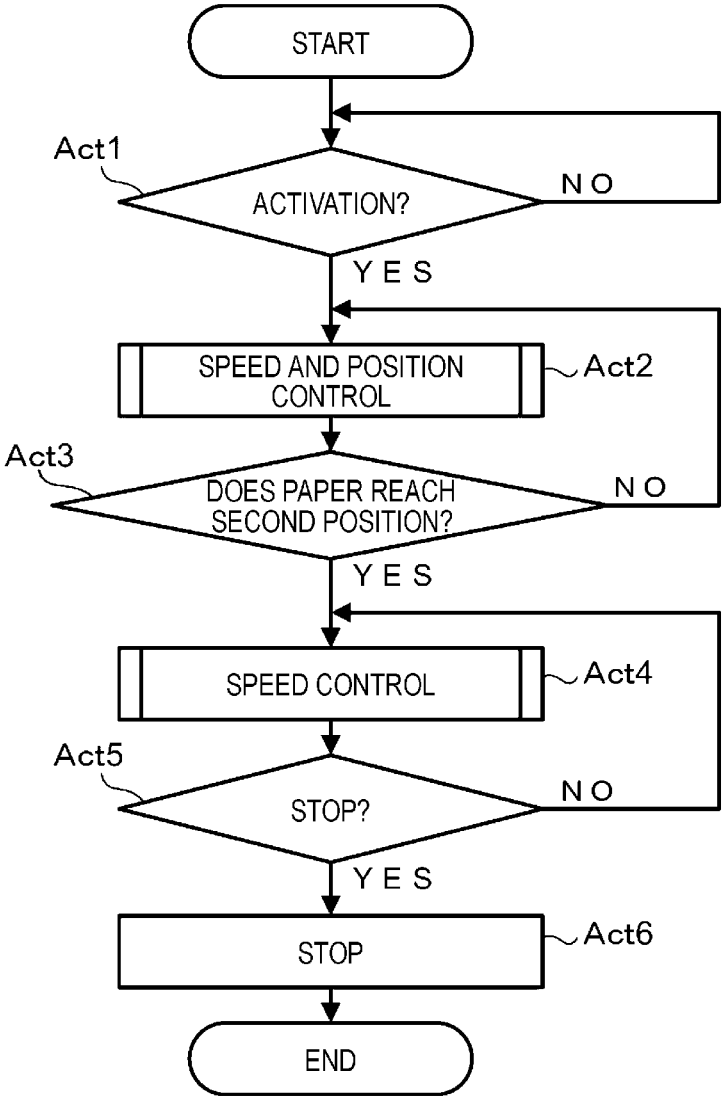
FIG. 8 is a flowchart illustrating an example of drive control processing of a registration roller motor.

FIG. 8 is a flowchart illustrating an example of drive control processing of the motor 133 for the registration roller 45 disposed at the first position on the conveyance path in the image forming apparatus. The MPU 101 performs the control processing illustrated in FIG. 8 according to a control program stored in the ROM 111.

The MPU 101 waits for the timing to activate the motor 133 for the registration roller 45 (Act 1). For example, based upon the image forming operation, the MPU 101 can determine whether or not the activation timing is reached according to whether or not the timing comes to move the paper to the second position which is the image transfer position where the intermediate transfer belt 33 and the transfer roller 34 come into contact with each other. As described above, the paper on which the image is to be formed is conveyed by the conveyance roller 44 up to the registration roller 45 in the stopped state. By waiting for the activation timing of the motor 133, the leading end of the paper in the conveyance direction is aligned in parallel with the registration roller 45.

Figure 9A:
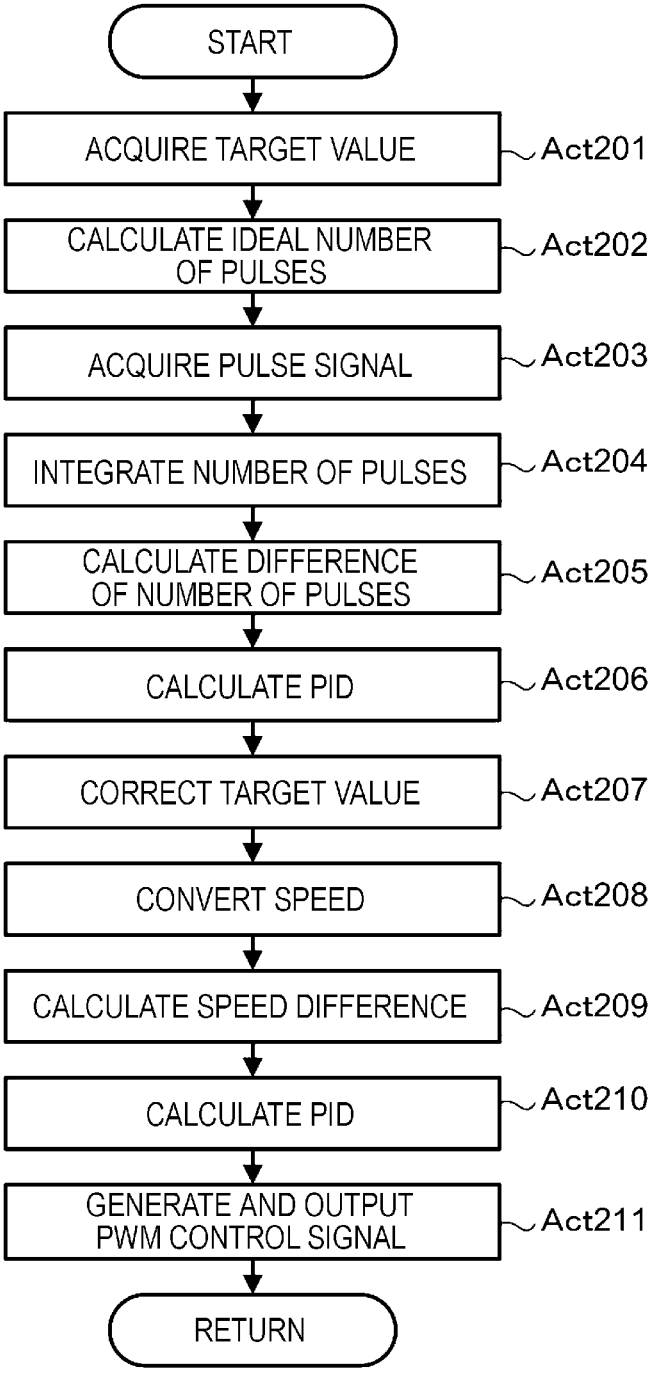
FIG. 9A is a flowchart illustrating an example of a speed and position control subroutine.

When it is determined that the timing for activating the motor 133 is reached (YES in Act 1), the MPU 101 executes control processing of a speed and position control subroutine (Act 2). FIG. 9A is a flowchart illustrating an example of the speed and position control subroutine.

The MPU 101 acquires a target value of a rotational speed (the number of rotations) of the motor 133 for the registration roller 45 (Act 201), and calculates a current ideal number of pulses based upon the target value of the rotational speed and an elapsed time from the start of activation (Act 202). The target value and the ideal number of pulses are stored in a register or the RAM 113 configured in the MPU 101.

The MPU 101 acquires a pulse signal indicating the actual rotational speed of the motor 133 output from the rotary encoder 120*a* via the I/O port 119 (Act 203).

The MPU 101 integrates the number of pulses from the acquired pulse signal (Act 204). The integrated result is stored in the register or the RAM 113 configured in the MPU 101 as a current pulse integrated value. The MPU 101 calculates a difference between the current ideal number of pulses obtained in Act 202 and the current pulse integrated value (Act 205). The MPU 101 calculates a correction amount of the target value of the rotational speed by performing the PID calculation on the obtained difference (Act 206). The MPU 101 corrects the target value of the rotational speed by adding the correction amount to the target value of the rotational speed acquired in Act 201 (Act 207).

Further, the MPU 101 converts the pulse signal acquired in Act 203 into an actual rotational speed of the motor 133 (Act 208). The rotational speed is obtained, for example, by the number of pulses per unit time. Further, the process of Act 208 may be performed before Act 204 to Act 207, that is, between Act 203 and Act 204, or may be also performed in parallel with Act 204 to Act 207.

The MPU 101 calculates a difference between the target value of the rotational speed (the number of rotations) corrected in Act 207 and the actual rotational speed (Act 209). The MPU 101 calculates an operation amount as a command value by performing the PID calculation on the obtained difference (Act 210). Next, the MPU 101 generates a PWM voltage command value in which the PWM duty is changed depending on the calculated operation amount as a PWM control signal, and outputs the generated PWM voltage command value to the motor driver 121, thereby driving the motor 133 by the motor driver 121 (Act 211).

Thereafter, the MPU 101 terminates the speed and position control subroutine.

When the speed and position control subroutine of Act 2 is terminated, the MPU 101 determines whether or not the leading end of the paper reaches the second position which is the image transfer position (Act 3). Whether or not the leading end of the paper reaches the second position can be determined, for example, by comparing a distance by which the leading end of the paper advances on the conveyance path from the first position where the registration roller 45 is disposed with a distance on the conveyance path between the first position and the second position. The distance by which the leading end of the paper advances on the conveyance path can be obtained based upon the pulse integrated value obtained in Act 204 of the speed and position control subroutine and a distance by which the leading end of the paper moves on the conveyance path per pulse. The moving distance per pulse is stored in advance in the ROM 111 as an apparatus configuration of the MFP 1. The distance on the conveyance path between the first position and the second position is also stored in advance in the ROM 111 as the apparatus configuration of the MFP 1.

When it is determined that the leading end of the paper does not reach the second position yet (NO in Act 3), the MPU 101 executes the control processing of the speed and position control subroutine of Act 2 again.

As described above, the paper on which the image is to be formed is pulled out of the paper feed cassette 41 by the paper feed roller 43, and conveyed up to the registration roller 45 disposed at the first position on the conveyance path by the conveyance roller 44. The timing at which the paper is moved to the second position which is the image transfer position is set by the registration roller 45, corresponding to the image forming operation. That is, the registration roller 45 restarts in accordance with the toner image formed on the intermediate transfer belt 33, and conveys the paper to the transfer roller 34 side disposed at the second position which is the image transfer position. The time required for conveying the paper at a section from the first position where the registration roller 45 is disposed up to the second position where the transfer roller 34 is disposed most largely contributes to a leading end position of the paper when the image is transferred from the intermediate transfer belt 33 onto the paper. Therefore, at the section from the first position to the second position, the MPU 101 performs the motor drive control using the speed control and the position control with respect to the motor 133 for driving the registration roller 45.

Figure 9B:
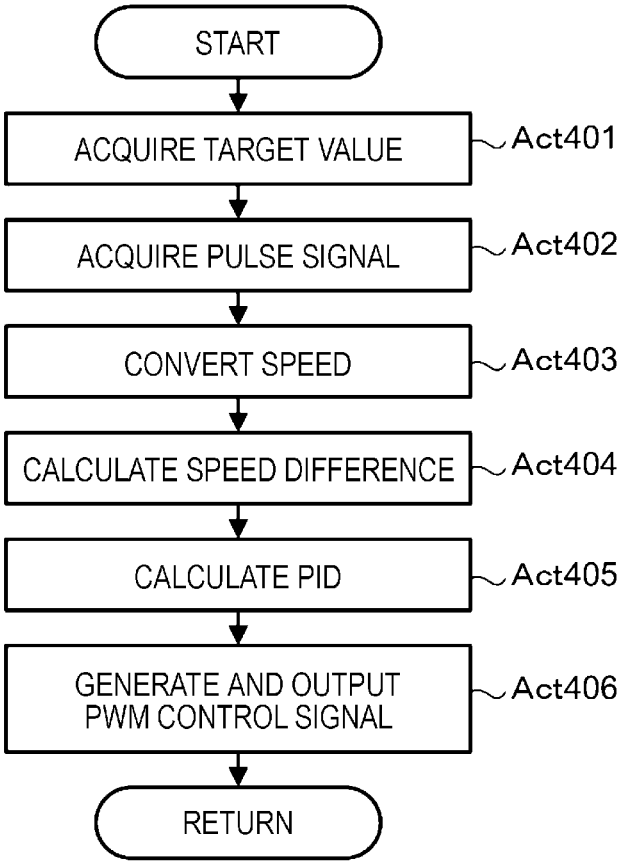
FIG. 9B is a flowchart illustrating an example of a speed control subroutine.

Thus, the motor 133 is driven and controlled by the motor drive control using the speed control and the position control, and the paper is moved by the registration roller 45. When it is determined that the leading end of the paper reaches the second position (YES in Act 3), the MPU 101 executes the control processing of the speed control subroutine (Act 4). FIG. 9B is a flowchart illustrating an example of the speed control subroutine.

The MPU 101 acquires the target value of the rotational speed (the number of rotations) of the motor 133 for the registration roller 45 (Act 401). The target value can be stored in the register or the RAM 113 configured in the MPU 101.

The MPU 101 acquires the pulse signal indicating the actual rotational speed of the motor 133 output from the rotary encoder 120*a* via the I/O port 119 (Act 402). The MPU 101 converts the acquired pulse signal into the actual rotational speed of the motor 133 (Act 403).

The MPU 101 calculates a difference between the target value of the rotational speed (the number of rotations) acquired in Act 401 and the actual rotational speed (Act 404). The MPU 101 calculates an operation amount as a command value by performing the PID calculation on the obtained difference (Act 405). Next, the MPU 101 generates a PWM voltage command value in which the PWM duty is changed depending on the calculated operation amount as a PWM control signal, and outputs the generated PWM voltage command value to the motor driver 121, thereby driving the motor 133 by the motor driver 121 (Act 406).

Next, the MPU 101 terminates the speed control subroutine.

When the speed control subroutine of Act 4 is terminated, the MPU 101 determines whether or not to stop the motor 133 (Act 5). Whether or not to stop the motor 133 can be determined by, for example, whether or not the paper is removed from the registration roller 45. Whether or not to stop the motor 133 can be determined by detecting the existence of the paper by an optical sensor or detecting the pressure applied to the registration roller 45 by a pressure sensor. Alternatively, whether or not to stop the motor 133 may be determined by whether or not the rear end of the paper advances further than the first position where the registration roller 45 is disposed. In this manner, even in the speed control subroutine of Act 4, the processing for integrating the number of pulses of Act 204 in the speed and position control subroutine of Act 2 may be continued, and the integrated value of the number of pulses may be used. That is, the rear end position of the paper can be calculated from a distance by which the leading end of the paper advances on the conveyance path from the first position where the registration roller 45 is disposed, which is indicated by the pulse integrated value, and a length in the conveyance direction of the paper which is known information. As a result, the MPU 101 can determine whether or not the rear end of the paper advances further than the first position by comparing the calculated rear end position with the first position.

When it is determined that the motor 133 is not stopped yet (NO in Act 5), the MPU 101 executes the control processing of the speed control subroutine of Act 4 again.

After the leading end of the paper reaches the transfer roller 34, the paper is conveyed by two rollers of the transfer roller 34 and the registration roller 45. At this time, if the speed of the registration roller 45 on the rear end side is unstable, an image blur occurs in the image transferred onto the paper. Therefore, after the leading end of the paper enters the transfer roller 34, the MPU 101 performs the motor drive control only by the speed control with respect to the motor 133 for the registration roller 45 in order to prioritize the speed stability.

Thus, the motor 133 is driven and controlled by the motor drive control using only the speed control, and the paper is moved by the registration roller 45. When it is determined that the rear end of the paper is removed from the registration roller 45 and the motor 133 is stopped (YES in Act 5), the MPU 101 stops outputting the PWM control signal to the motor driver 121, and stops driving the motor 133 by the motor driver 121 (Act 6).

Next, the MPU 101 terminates the drive control processing of the motor 133.

According to the embodiment described above, it is possible to perform the control in which a merit of the speed control and a merit of the combination of the speed control and the position control are compatible with each other by obtaining a configuration in which the drive control of the motor 133 for driving the registration roller 45 is switched according to the leading end position of the paper. Accordingly, since high positional accuracy and speed stability can be achieved at the second position which is the image transfer position, the MFP 1 capable of forming a high-quality image can be obtained.

Further, in the determination of the stop of Act 5, it is described on the assumption that the distance between the first position and the second position along the paper conveyance path is shorter than the length of the paper with the shortest length in the conveyance direction of the paper among the paper sizes to be used. An interlocking roller driven by the motor 133 for the registration roller 45 in interlocking with the registration roller 45 can be arranged between the first position and the second position. When the above-described interlocking roller is disposed, whether or not to stop the motor 133 is determined by determining whether or not the paper is removed from the interlocking roller instead of the registration roller 45.

Figure 10:
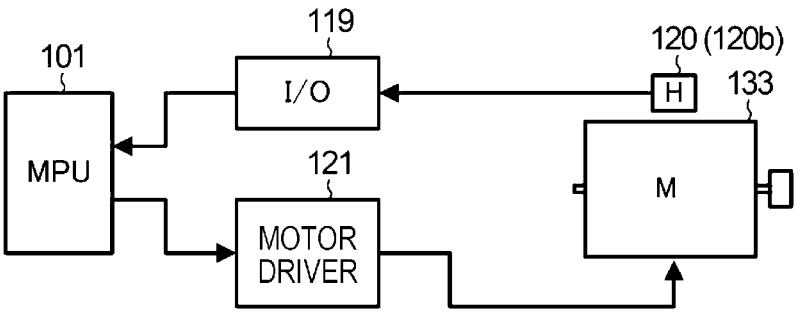
FIG. 10 is a schematic diagram illustrating another example of the sensor that detects the rotational position of the motor.

Further, the sensor 120 for detecting the rotational position of the motor 133 may be a sensor other than the rotary encoder 120*a*. FIG. 10 is a schematic diagram illustrating another example of a sensor that detects the rotational position of the motor 133. The motor 133 is a brushless DC motor, and the sensor 120 can use, for example, a hall element 120*b* that detects a change in a magnetic field accompanying the rotation of the brushless DC motor.

Further, the position of the paper is determined based upon the output of the sensor that detects the rotational position of the motor 133, but the MFP 1 may detect the position thereof with higher accuracy by using a position detection sensor that optically detects the paper position.

While certain embodiments have been described, these embodiments have been presented by way of example only, and are not intended to limit the scope of inventions. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a first roller configured to acquire a sheet;

a second roller disposed at a first position on a conveyance path of the sheet on which an image is to be formed, the roller configured to receive the sheet from the first roller and send the sheet toward an image transfer position on the conveyance path downstream from the first position on the conveyance path;

a motor configured to drive the second roller; and a controller configured to control the motor using both speed control for keeping a rotational speed of the motor at a target speed and position control for keeping a rotational position of the motor at a target position when a leading end of the sheet is at a position between the first position and the image transfer position, and to control the motor using only the speed control when the leading end of the sheet reaches the image transfer position.

2. The apparatus according to claim 1, wherein the controller is further configured to control the motor in accordance with a timing at which an image is transferred onto the sheet.

3. The apparatus according to claim 1, further comprising:

a sensor configured to detect the rotational position of the motor.

4. The apparatus according to claim 3, wherein the controller is further configured to control the motor based upon an output of the sensor so as to coincide with the timing at which the image is transferred onto the sheet.

5. The apparatus according to claim 3, wherein the motor comprises a DC motor or a brushless DC motor, and the sensor comprises a rotary encoder that detects a rotation of a shaft of the DC motor.

6. The apparatus according to claim 3, wherein the motor comprises a brushless DC motor, and the sensor comprises a hall element that detects a change in a magnetic field accompanying a rotation of the brushless DC motor.

7. The apparatus according to claim 3, wherein the controller is further configured to determine a position of the leading end of the sheet on the conveyance path based upon an output of the sensor.

8. The apparatus according to claim 1, further comprising:

a transfer roller disposed at the image transfer position, and to transfer a toner image onto the sheet by causing the sheet to come into close contact with a medium on which the toner image corresponding to the image.

9. A paper conveyance method in an image forming apparatus including a first roller configured to acquire a sheet, a second roller at a first position that receives the sheet from the first roller and sends the sheet on which an image is to be formed onto a conveyance path, and a motor configured to drive the second roller, the method comprising:

sending the sheet toward an image transfer position from the first position on the conveyance path by controlling the motor using both speed control to keep a rotational speed of the motor at a target speed and position control to keep a rotational position of the motor at a target position when a leading end of the sheet is between the first position and the image transfer position; and controlling the motor using only the speed control when the leading end of the sheet reaches the image transfer position.

10. The method according to claim 9, further comprising:

controlling the motor in accordance with a timing at which an image is transferred onto the sheet.

11. The method according to claim 9, further comprising:

detecting the rotational position of the motor.

12. The method according to claim 11, further comprising:

controlling the motor based upon a detecting result so as to coincide with the timing at which the image is transferred onto the sheet.

13. The method according to claim 11, wherein the motor comprises a DC motor or a brushless DC motor, and further comprising:

detecting a rotation of a shaft of the DC motor.

14. The method according to claim 11, wherein the motor comprises a brushless DC motor, and further comprising:

detecting a change in a magnetic field accompanying a rotation of the brushless DC motor.

15. The method according to claim 11, further comprising:

determining a position of the leading end of the sheet on the conveyance path based upon a result of the detecting.

16. The method according to claim 9, further comprising:

transferring a toner image onto the sheet by causing the sheet to come into close contact with a medium on which the toner image corresponds to the image.

17. A non-transitory computer readable medium storing a program that causes a controller in an image forming apparatus to perform:

acquiring a sheet with a first roller;

receiving the sheet from the first roller and sending the sheet from a first position toward an image transfer position on the conveyance path by controlling a motor that drives a second roller at the first position using both speed control to keep a rotational speed of the motor at a target speed and position control to keep a rotational position of the motor at a target position when a leading end of the sheet is between the first position and the image transfer position on the conveyance path; and controlling the motor using only the speed control when the leading end of the sheet reaches the image transfer position.

18. The non-transitory computer readable medium according to claim 17, that causes the controller to further perform:

controlling the motor in accordance with a timing at which an image is transferred onto the sheet.

19. The non-transitory computer readable medium according to claim 17, that causes the controller to further perform:

detecting the rotational position of the motor.

20. The non-transitory computer readable medium according to claim 19, that causes the controller to further perform:

controlling the motor based upon a detecting result so as to coincide with the timing at which the image is transferred onto the sheet.

* * * * *